United States Patent [19]

Smith

[11] 4,222,509

[45] Sep. 16, 1980

[54] ADHESIVE TAPE DISPENSER

[76] Inventor: Clayton K. Smith, 45 S. Edgewood, Grosse Pointe Shores, Mich. 48236

[21] Appl. No.: 22,288

[22] Filed: Mar. 20, 1979

[51] Int. Cl.[3] ..... B26F 3/02

[52] U.S. Cl. ..... 225/77; 225/91

[58] Field of Search ..... 225/77, 90, 91, 46

[56] References Cited

U.S. PATENT DOCUMENTS

| | | | |
|---|---|---|---|
| Re. 23,129 | 6/1949 | Borden | 225/77 X |
| 2,640,656 | 6/1953 | Donkin | 225/77 X |

FOREIGN PATENT DOCUMENTS

| | | | |
|---|---|---|---|
| 73722 | 1/1952 | Denmark | 225/46 |
| 83938 | 11/1957 | Denmark | 225/46 |

*Primary Examiner*—Frank T. Yost

*Attorney, Agent, or Firm*—Willis Bugbee

[57] ABSTRACT

This adhesive tape dispenser is of one-piece construction with a flat horizontal rectangular base portion adapted to rest on the table. A flat rectangular tape-roll-holding portion rises at an acute angle to the base portion and has an inclined tape-roll-receiving slot of rectangular outline, the width of which corresponds to the width of the tape and the length of which is slightly smaller than the minimum diameter of the tape on the core upon which the tape is unwound. Rising from the opposite end of the base portion is a tape severing portion at the top of which is a horizontal edge provided with cutoff saw teeth.

A modification has stepped upper and lower edges of the slot adapted to receive tape rolls of either of two standard tape widths.

8 Claims, 3 Drawing Figures

FIG. 2
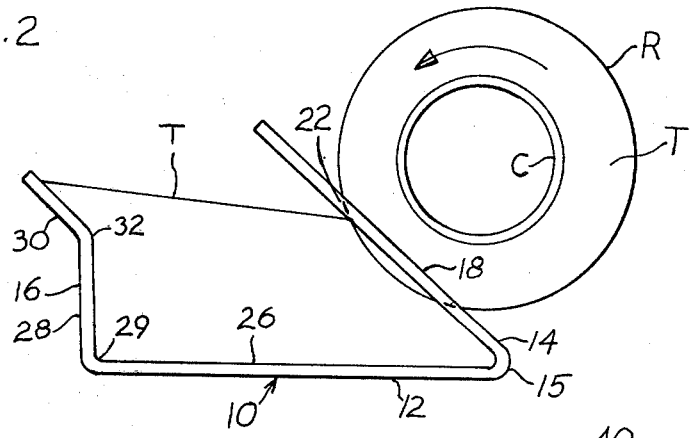
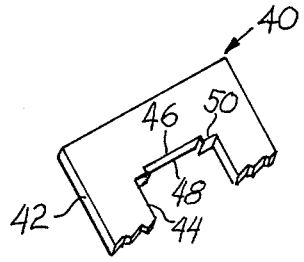
FIG. 3
FIG. 1
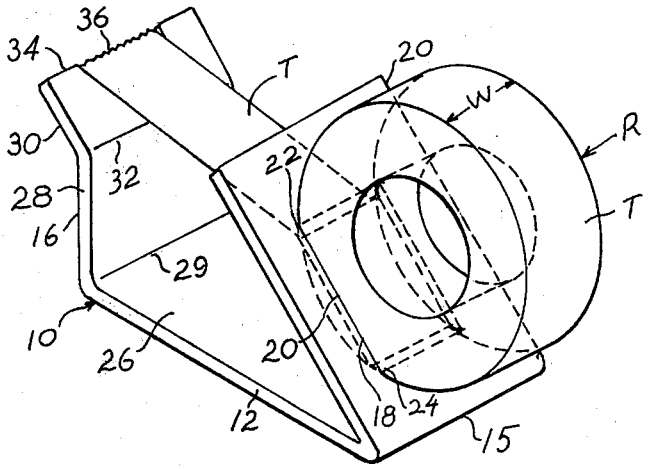

ADHESIVE TAPE DISPENSER

BACKGROUND OF THE INVENTION

Previously known are trough-shaped paper roll holders with cutting edges spaced away from the trough. Also previously known are comma-shaped adhesive tape dispensers wherein the tape roll is mounted on the hollow cylindrical support while the cutting edge is on an arm spaced away from the cylindrical support.

SUMMARY OF THE INVENTION

The present invention principally resides in the inclined roll-holding portion with the slot containing the adhesive tape roll urged by the force of gravity downward against the opposite parallel horizontal edges of the slot; also in the one-piece construction thereof integral with the base and with the upstanding tape cutoff portion. The invention also resides in the modified tape holder with the stepped upper and lower horizontal slot edges adapted to receive a plurality of widths of tape rolls.

In the drawing,

FIG. 1 is a perspective view, looking downward from above, of an adhesive tape dispenser according to one form of the invention;

FIG. 2 is a left-hand side elevation of the adhesive tape dispenser shown in FIG. 1, with an arcuate arrow indicating the direction of rotation of the tape roll as the tape is unwound and dispensed from it; and FIG. 3 is a fragmentary perspective view of the upper portion of a modified adhesive tape dispenser adapted to utilize two different standard widths of tape rolls.

Referring to the drawing in detail, FIG. 1 shows an adhesive tape dispenser, generally designated 10, according to one form of the invention resembling a slant-sided approximately U-shaped structure and consisting generally of a horizontal flat base portion 12 from the opposite ends of which rise an inclined adhesive tape roll holding portion 14 and a tape severing portion 16, the portions 12, 14 and 16 being integral with one another and conveniently formed by stamping dies from metal or by plastic injection molding from synthetic plastic material. The tape roll holding portion 14 is flat and rises at an angle of approximately 45 degrees with respect to the likewise flat base portion 12 around a bend line 15 which is also flat.

In order to support the tape roll R and at the same time utilize the force of gravity to hold it in place, the tape roll holding portion 14 is provided with an elongated rectangular slot 18 having opposite parallel side edges 20 and top and bottom edges 22 and 24 respectively. The side edges 20 are spaced apart from one another by a distance which is slightly greater than the width W of the tape roll R and consequently slightly greater than the width of the tape T itself. The top and bottom edges 22 and 24 of the slot 18 are spaced apart from one another by a distance slightly less than the diameter of the core.

The tape severing portion 16 consists of a lower section 28 substantially perpendicular to the base portion 12 around a bend line 29, and an upper section 30 subtending an obtuse angle with the lower section 28 around a bend line 32. The upper section 30 slants away from the tape holding portion 14 and terminates in an upper edge 34 having a serrated or saw-toothed tape-severing section 36.

The modified adhesive tape dispenser, generally designated 40 shown in FIG. 3 is in all respects similar to the dispenser 10 with the exception that the inclined adhesive tape roll holding portion 42 has a slot 44 with stepped upper and lower edges 46, both edges being identical hence not shown in FIG. 3. Each of the stepped edges 46 includes a central narrower portion 48 to accommodate narrower standard width tape rolls R and a broader width portion 50 separated from the narrower width 48 by steps or shoulders 52 to accommodate broader standard width tape rolls R. Thus, the modified tape dispenser 40 enables both narrow and broad width tape rolls to be used alternately and interchangeably with one another according to the needs and requirements of the user.

The operation of either of the adhesive tape roll dispensers 10 or 40 is believed to have been sufficiently described in connection with the statement of the construction thereof, hence is thought to require no repetition. Before dispensing tape, the free end of the tape T is pried loose from the remainder of the roll R and threaded through the slot 18 while the tape roll R is dropped into the latter. The user then inserts his thumb and forefinger into the space between the base portion 12 and the inclined portion 14 immediately beneath the upper edge 22, and grasps the free end of the tape T which has been separated from the remainder of the roll R. He then pulls this free end toward the tape severing portion 16 until the desired length of tape is measured off from the serrated cutting edge 36, whereupon he pulls downward upon it to tear it off at the serrated cutting edge 36.

I claim:

1. A dispenser for adhesive tape from a roll thereof spirally wound in a hollow cylindrical body upon a tubular core, said dispenser comprising a substantially flat rectangular base portion adapted to rest upon a supporting surface, an upwardly-inclined tape roll holding portion rising at an acute angle from one end of said base portion in overhanging relationship thereto, said roll-holding portion having an upwardly-elongated slot therein shaped to receive and hold a conventional adhesive tape roll, and an upstanding tape severing portion rising from the opposite end of said base portion and having a tape-severing edge thereon in the upper part thereof.

2. An adhesive tape dispenser, according to claim 1, wherein said slot has substantially parallel upper and lower edges spaced apart from one another by a distance greater than the diameter of the hollow cylindrical body of wound tape on the core of the tape roller.

3. An adhesive tape dispenser, according to claim 2, wherein said tape-severing edge is disposed at approximately the same height above said base portion as the upper edge of said slot.

4. An adhesive tape dispenser, according to claim 1, wherein said tape-severing portion has a lower part and an upper part inclined relatively thereto in a direction away from said tape roll holding portion.

5. An adhesive tape dispenser, according to claim 1 wherein said tape-severing edge has tape-severing serrations thereon.

6. An adhesive tape dispenser, according to claim 1, wherein said base portion, said tape roll holding portion and said tape severing portion are substantially plate-shaped.

7. An adhesive tape dispenser, according to claim 1, wherein said base portion, said tape roll holding portion and said tape severing portion comprise a one-piece integral structure.

8. An adhesive tape dispenser, according to claim 1, wherein said tape roll holding portion is inclined at an acute angle of approximately 45 degrees to said base portion.

* * * * *